US005727746A

United States Patent [19]

Fabschitz

[11] Patent Number: 5,727,746

[45] Date of Patent: Mar. 17, 1998

[54] THREAD FEEDER DEVICE W/ CONTINUOUSLY ADJUSTABLE THREAD EXTRACTION TENSIONING

[76] Inventor: Heinrich Fabschitz, Naringerstrasse 18b, D-83620 Feldkirchen-Westerham, Germany

[21] Appl. No.: 637,766

[22] PCT Filed: Oct. 25, 1994

[86] PCT No.: PCT/DE94/01258

§ 371 Date: Aug. 12, 1996

§ 102(e) Date: Aug. 12, 1996

[87] PCT Pub. No.: WO95/12017

PCT Pub. Date: May 4, 1995

[30] Foreign Application Priority Data

Oct. 29, 1993 [DE] Germany ..... 43 36 994.4

[51] Int. Cl.[6] ..... B65H 51/00; B65H 59/22; D03D 47/36; D04B 15/48

[52] U.S. Cl. ..... 242/364; 242/47.01; 242/150 R; 66/132 R; 139/452

[58] Field of Search ..... 242/47.01, 364, 242/150 R, 149; 139/452, 224 A; 66/132 R, 146, 132 T

[56] References Cited

U.S. PATENT DOCUMENTS

| | | | |
|---|---|---|---|
| 3,225,446 | 12/1965 | Sarfati | 242/47.01 X |
| 4,068,807 | 1/1978 | Jacobsson | 242/47.01 |
| 4,079,759 | 3/1978 | Riha et al. | 139/452 |
| 4,429,723 | 2/1984 | Maroino | 242/47.01 X |
| 5,489,068 | 2/1996 | Vischiani | 139/452 X |
| 5,546,994 | 8/1996 | Sarfati | 242/47.01 X |
| 5,553,641 | 9/1996 | Zenoni | 242/47.01 X |

FOREIGN PATENT DOCUMENTS

| | | |
|---|---|---|
| 16 35 899 | 4/1970 | Germany . |
| 25 40 749 | 3/1977 | Germany . |
| 34 29 219 | 2/1986 | Germany . |
| 374 345 | 12/1963 | Switzerland . |
| 2 005 739 | 4/1979 | United Kingdom . |
| 91 14032 | 9/1991 | WIPO . |
| WO9635834 | 11/1996 | WIPO . |

*Primary Examiner*—Michael Mansen
*Attorney, Agent, or Firm*—Greer, Burns & Crain, Ltd.

[57] ABSTRACT

The invention relates to a thread feeder device with continuously adjustable thread extraction tension for textile machines, particularly for textile machines having uneven thread consumption, with a storage body that carries the thread without slippage and is directly or indirectly actuated by a motor and whereon the thread, in order to form a storage reserve winding, is wound tangentially and (according to requirements) is unwound axially between its front face, provided as a braking surface, and a complementary braking surface that rotates in the same direction. According to the invention, the complementary braking surface is formed by a thin, flexible circular disk the diameter whereof is slightly larger than the diameter of the front face of the storage body. The elasticity of this disk is used to achieve a more uniform thrust pressure on each point of the braking surface of the storage body, and to secure the thread more or less tightly by means of a more or less intense thrust pressure, i.e., to brake the thread, in order to allow the thread extraction tension to be continuously adjustable over wide ranges. Therefore, the thread is prevented from flying away and at the same time an unwanted rotation of the winding of the storage body is suppressed.

21 Claims, 3 Drawing Sheets

THREAD FEEDER DEVICE W/ CONTINUOUSLY ADJUSTABLE THREAD EXTRACTION TENSIONING

BACKGROUND OF THE INVENTION

The invention relates to a thread feeder device for storing and feeding thread for textile machines having uneven rates of thread consumption, such as occurs in knitting or weaving machines that are capable of patterned knitting, Jacquard knitting, circular knitting, plating, and for example half plush and full plush weaving. The thread feeder device has a storage body which carries the thread without splippage and is actuated by a motor, in order to form a reserve thread winding. The thread is wound axially and tangentially, and according to requirements, it is unwound axially from said storage body between its front face, provided as a braking surface, and a complementary braking surface that rotates in the same rotational direction. The complementary braking surface is movable in an axial direction with respect to the braking surface of the storage body in order to vary the thread extraction tension.

Known devices of this type essentially have the drawback that although the thread extracted in an axial direction is prevented from lifting or flying away from the storage body by providing annular members located loosely on the storage body (e.g. metal ring, plastic ring, comb-shaped plastic ring, brushes, or the like), the known devices cannot provide the desired thread extraction tension (i.e., the tension applied to the thread which is supplied to a respective knitting machine) which is required for carrying out a flawless knitting process. In practice, the thread slides away from the storage body with a tension that is considerably lower than that with which it is fed to the storage body. To achieve a thread feed tensioning that is final and correct for knitting with the operating system of the knitting machine, an additional thread brake must accordingly be provided between the storage device and the knitting machine.

This solution for setting a correct tensioning of the thread fed to the knitting machine is not optimal, since the difficulties arising from thread braking are well-known: the cup-shaped brake, used in most cases, is difficult to adjust, and does not maintain the set value constantly (at least not for a long period of time). Furthermore, as thread enters the cup-shaped brake, fibers and particles of thread become deposited therein, thereby soiling the brake. Moreover, this known type of thread brake amplifies irregularities which occur when extracting the thread from the storage body and at the passage of the annular member or ring, constituted, e.g., by an annular comb or an annular brush. Unwanted flutter of the thread also often occurs, whereby individual needles may be unable to engage the thread; resulting in undesirable, irregular knitting, thereby causing the knitting machine to produce rejects.

In a conventional device of this type (Swiss patent publication 374 345) there is absolutely no annular arrangement that must retain the thread that exits axially from the storage body on the perimeter thereof. Instead, the thread, during extraction, upon operation of the knitting or weaving machine, forms a so-called balloon of thread, to achieve among other things the lowest possible thread tension; however, this is completely unusable, in practice at least in conventional knitting machines.

In another known device of this type (U.S. Pat. No. 3,225,446), a thread is wound tangentially on a winding body or storage body to form a reserve winding and is then extracted axially from said body. Although the thread, by means of an elastic ring, is prevented from flying away and from lifting in an uncontrolled manner away from the winding body, it is necessary to produce a preset thread extraction tension. In practice, this proposed solution is unusable, because the elastic ring is difficult to manufacture with the precision required in this case, especially with the necessary long-lasting constancy of precision, and furthermore, because each type and thickness of thread being used and each different thread extraction tension would require a special manufacture, for example from the point of view of the nominal diameter of the ring and/or of its elasticity. Furthermore, fine adjustment due to the machine and the thread, which according to experience must always be performed from the outset for each item of knitwear and throughout the entire production schedule, is not possible.

A device for storing and feeding thread for textile machines of this type is also known (German publication 1 635 899) which is equipped with a winding body whereon the thread, to form a reserve of thread, can be wound tangentially and can thus be extracted from said body axially, i.e., through a slide member that rotates around said body along a flange at the tip of the winding body. As a further alternative, it is possible to replace the slide member with a ring having a larger diameter than the winding body. Constructive difficulties however arise: the ring must in fact have a smaller diameter than the flange but a larger diameter than the winding body; furthermore, the winding body can be actuated only vertically and with the flange side facing downwardly. Moreover, there is the danger that a ring having a diameter that is slightly too large (with respect to the diameter of the winding body) could, in the event of an increased rate of rotation, start to move in an ovoid path, thus no longer ensuring the intended and desired constancy of the thread extraction tension. Therefore, comb-like plastic rings, with different resistances for different application purposes, were introduced a long time ago. However, the inlet tensioning of the thread, fed to the machine, as required for correct knitting, cannot be set with the aid of these plastic comb-like rings; the value that is achieved (most of the time, an excessively low value) is only static, i.e., it cannot be modified; an additional thread brake, with the drawbacks that have already been described extensively hereinabove, must be applied between this device and the textile machine at some point along the thread path.

Devices of this kind are also known which have a braking ring that is separate from the storage body and rotates in the same direction. Japanese publication JP-93 757/1973 discloses a thread feeder device with a storage body actuated by a DC motor, and a front face that protrudes to define a conical configuration, against which a complementary braking surface rests; said braking surface is provided in the form of a brush-like ring and is supported by a funnel-shaped structure approximately at the wider end of the conical configuration that tapers towards the center. By means of a transmission arrangement, provisions are made by the actuation system of the storage body for a synchronous rotation of said brush-like ring with the storage body. The brush ends are arranged slightly at an angle, to prevent the thread from jamming in the brushes. An axial movement of the brush-like ring is provided only in order to space the storage body from the front face to allow, for example, thread insertion. The thread extraction tension, in the case of this thread feeder device, cannot be either preselected or modified.

Another thread feeder device with a rotating storage body and with a rotating braking ring, but equipped with a rubber ring formed by a disk, is known from U.S. Pat. No. 4,068, 807. The rubber ring, which constitutes an elastic braking ring, is retained by a funnel-shaped element, or clamped therein. The funnel-shaped element is supported in such a manner that it can rotate and move axially. Accordingly, provisions must be made to allow to vary the thrust pressure of the inner edge of the elastic braking ring on the conically deformed front face of the storage body, whereby to vary the thread extraction tension as well. Since no rotatable actuation system is provided for the funnel-shaped element or the elastic braking ring, only the forced friction of the inner edge of the braking ring on the point of contact all around the conical part of the storage body causes a rotation that matches a respective thrust pressure. The relatively large mass of the funnel, including a braking ring and its support, and the friction generated thereby, is a drawback: The acceleration and braking characteristics of the breaking ring are therefor highly dependent on the actual slippage between the two rotating parts. However, this causes undesired rotation of the reserve winding and consequently, an unwanted variation in the tension of the thread. This effect can be reduced only if excessively fast variations in the rotation rate of the storage body do not occur. This again limits the use of this thread feeder device. Moreover, the conditions upon the movement of the thrust pressure vary continuously, and this does not ensure reliable operation over a wide adjustment range.

Another conventional thread feeder device is described hereinafter with the aid of some examples. DE 25 40 749 describes a thread feeder device having a static storage body or drum with an associated braking ring. The thread is wound tangentially by means of a winding element on the storage body to form a storage reserve and is extracted axially on its front face, which is provided as a braking surface (i.e., an annular surface formed radially). A braking ring provided as a cup-shaped body, provided with thin, long, elastic circular fingers arranged approximately on the outside perimeter, forms the complementary braking surface. Furthermore, said fingers pass on the annular surface of the storage body, at a certain angle. By means of an adjustment screw, it is possible to modify the distance of the braking ring from the front surface of the storage body. Thus, by modifying the variable thrust pressure, the thread tensioning is also modified. The disadvantages of this known arrangement are mainly associated with the complicated and expensive manufacture of the braking ring, which has numerous long and thin, elastic fingers, and with the fact that this construction causes problems due to weight: The entire weight of the braking ring is nonetheless discharged onto the front face of the storage body when located in an operating position. In this operating position, the thread inlet is located upwardly and the thread exit is located downwardly on the device. This also means that a certain basic thrust pressure is always exerted due to the weight of the parts, and this can only be increased by means of an adjustment screw. Even if actuated in other positions, new factors that cannot be calculated again occur. Consequently, the adjustment range of thread tensioning of this thread feeder device is very limited.

Known from DE-A1-3429219 is a thread braking ring that can be compared directly with the one known from patent publication JP-93 757/1973, with the only difference that the device known from DE-A1-3429219 has a static storage body and a braking ring.

Also known from GB 2005 739 is a thread feeder device with a static storage body and a braking ring which is axially movable. Differently from other conventional solutions, this thread braking device has brush-like elements or bristles, which are inserted in a tip portion of a storage body, and an axially movable annular ring which acts as a complementary braking surface. In principle, however, no advantages arise with respect to conventional solutions; on the contrary, due to the guide/support action exerted by the bristles on both sides of the storage body, said bristles accordingly become relatively rigid and fine adjustment of the thread extraction value cannot be performed. Furthermore, this bristle arrangement facilitates rapid wear of the bristles in their central region, i.e., exactly where the braking ring pushes the thread. Thus, thread tensioning devices with brushes or brush-like rings are not ideal for correct, constant, and easily adjustable thread tensioning. Fraying, dirtying, poor adjustment possibilities, the expensive manufacture, as well as rapid wear are some of the substantial drawbacks of this type of thread tensioning device.

WO 91/14032 describes a thread braking arrangement which interacts with a thread feeder device and has the purpose of adjusting and allowing control of the thread extraction tension and respectively of the tension of the thread when it leaves the storage body, and also that of providing said body with a cleaning function. Substantially, this arrangement is constituted by two mutually opposite circular parts, each having an annular braking surface, between which the thread is guided so as to obtain a braking effect, in a manner which is substantially identical to the function of a conventional cup-shaped brake. Here, there is the drawback that the useful diameter of the annular braking surfaces is selected so that it is significantly smaller than the diameter of the storage body and therefore also smaller than the diameter of the resting surface and respectively of the extraction surface of the thread. In such embodiments with a static braking body, if the thread speed varies suddenly from a high value to a lower value, the reserve winding rotates, because the piece of thread from the end of the last turn on the storage body up to the point where it is held between the two braking parts is very long and, in compliance with the rules that govern centrifugal force, it therefore lifts away from the storage body. As a consequence, the monitoring system of the storage winding goes out of phase, the thread extraction tension can vary, and/or the wound thread jams or catches somewhere in the thread feeder device. Correct feeding of the thread to the knitting machine is therefore not ensured.

SUMMARY OF THE INVENTION

Accordingly, an aim of the invention is to provide a thread storage and feeder device of the above-described type, having the desired characteristics, as well as simple structure and operation, and which furthermore operates reliably in all the fields of operation. The thread (3) to be knit or woven is wound tangentially on a storage body (9) which is rotatably supported and carries it without slippage, to form a reserve winding, and is then extracted axially (according to requirements) between the front face, provided as a braking surface (9'), and a complementary braking surface that rotates in the same direction and is axially movably supported.

According to the invention, the complementary braking surface is formed by a thin flexible disk (10), preferably made of a wear-resistant material such as a plastic or a metal, the diameter of which is slightly larger than that of the front face (9') of the storage body. The elasticity of this disk is utilized to achieve a more uniform thrust pressure on every point of the braking surface (9') on the front face of the storage body, so that the thread, by means of a more or less intense thrust pressure, is clamped, i.e., braked more or less intensely, so that the thread extraction tension is adjustable continuously over wide ranges. Simultaneously, therefore, the thread is prevented from flying off the storage body and rotation of the reserve winding is suppressed.

The thread is extracted at the center of the disk (10), which has a wear-free passage (25); the disk is located on a hub (13) that is in turn mounted on a hollow shaft (17). The entire structure is rotatably supported and movable in a parallel and central fashion and in a planar manner in both planes with respect to the storage body and with respect to its braking surface (9') on the front face.

In practice, for adjusting the thread extraction value it is irrelevant whether the storage body (9) with its braking surface (9') on the front face is moved relative to the disk (10) of the complementary braking surface or vice versa, or whether indeed both are moved simultaneously with respect to one another. However, since in the embodiment described herein the thread guiding means (5, 6, 7) associated with the storage body are advantageously rigidly connected to the frame (2) of device, the functional block with the complementary braking surface is preferably mounted on a slider (26) that is movable on the longitudinal axis of the storage body. It will be clear to a person skilled in the art that the storage body can also be mounted, for example, in a known manner on a slider, such as the slider (26) for the thin disk (10).

The slider (26), which is mounted in a movable manner on the frame (2) of the device practically without play by means of a threaded rod (16). At the end of the rod (16) is a knob (18), which moves a pointer (15) for providing a visual indication on a clearly visible scale (27), of the thread extraction value, i.e., the degree of thread tensioning that has been respectively set. It is known that different threads have different friction values, and therefore an adjustment chosen once on the above-mentioned scale, when changing to another type of thread, may cause another thread extraction value. The sense and aim of the present invention, however, besides other objects, is to effortlessly set practically any necessary value during the inactivity or operation of the knitting machine, and to keep this value set once for a given type of thread for a long time, and to again reproduce this value even after intervening modifications to another value.

The disk (10) of the complementary braking surface and the associated functional parts are protected by means of an annular cover (33). This cover also very effectively prevents unwanted winding of the thread on the shaft from the disk (10) of the complementary braking surface, if for any reason the winding should fall off the storage body, for example due to a thread extraction value that has been set too low, so that the last turns of the thread of the reserve winding (8), due to the centrifugal forces and also to air resistance, in the case of a high-speed rotation rate, lift away from the storage body (9), and otherwise the interfering balloon effect of the thread would occur.

The device according to the invention operates as follows: before starting the knitting machine, the device must be switched off by means of the switch (24). The thread (3) to be knitted is inserted through the eyelet (5), the thread brake (6), and the eyelet (7), and is then made to slide radially between the braking surface (9') on the front face (9') of the storage body and the disk (10) of the complementary braking surface, and then through the center of the passage (25) without wear, approximately at the rear third of the storage body (9) with respect to its axial extension from the front face. By means of an insertion aid, the thread is pulled through the hollow shaft (17) and guided to the knitting point of the machine provided for this purpose. To wind a storage reserve winding (8) for the first time it is advantageous if both on the thread inlet and on the thread exit sides a small loop and a slightly greater clamping effect of the two braking surfaces are provided. For this purpose, first of all the thread is pulled after the hollow shaft (thread outlet of the device) and then in front of the thread inlet of the device, and with the aid of the adjustment knob (18), a slightly higher value is set for thread extraction tensioning; usually, it is sufficient for the pointer (15) on the scale (27) to be in the central position. Thereafter, the device is switched on by means of the switch (19), and the storage reserve winding, which is essential for trouble-free operation, forms automatically (assuming that conventional sensor means are provided, not described in greater detail, for monitoring the width of the reserve winding, which control the driving motor or motors for the storage body and the disk of the complementary braking surface by means of a motor adjustment device not shown, in a corresponding manner). For the definite adjustment of the correct thread extraction tensioning value, either an already-known value is set on the scale or a new value is determined for example with the aid of a correct piece of knitting.

BRIEF DESCRIPTION OF THE DRAWINGS

The subject of the invention is described in greater detail by way of example with the aid of the accompanying schematic drawings, wherein:

FIGS. 1 and 2 are general side views of the device, with the various covers of the body shown in FIG. 1 and omitted in FIG. 2. This type of device, usually by means of a retention bracket 1, is mounted on a supporting beam having room for a plurality of devices and being in turn fixed to the knitting machine near the knitting zone to be fed.

FIG. 2 allows to clearly follow the path of the thread through the device. The incoming thread (3) is moved closer through the inlet eyelet (5), the thread brake (6), and the guiding eyelet (7) are arranged tangentially to the storage body (9), and a storage reserve winding (8) is formed on said storage body (9) by means of a number of turns. The thread is then passed between the braking surface (9') on the front face of the storage body (9) and the complementary braking surface, provided as a thin, flexible circular disk (10) having a diameter which is slightly greater than that of the front face of the storage body; the thread is secured and extracted from the outside through the wear-free passage (25) of the body and the central hollow shaft (17), which is also the driving shaft of the motor (14) for the disk of the complementary braking surface.

FIG. 5 illustrates this process more clearly. The storage reserve winding provided on the storage body (9) is made to pass axially between the front face of the storage body and the complementary braking surface, provided as a thin and flexible disk (10), and according to the thrust pressure, the thread is secured more or less intensely and extracted from the outside through its wear-free passage (25) and the central hollow shaft (17).

FIG. 2 also illustrates the movable slider (26), on which there is fixed, in this embodiment, the motor (14) for driving the complementary braking surface, provided as a thin and flexible disk (10). By turning the adjustment knob (18), by means of the threaded rod (16), the slider, according to the position on the frame (2), and therefore the complementary braking surface provided as a disk (10), is compressed more or less intensely against the braking surface (9') on the front face of the storage body (9).

Finally, FIG. 6 is a view of a different embodiment including only one driving motor, wherein the disk (10) of the complementary braking surface is actuated by means of gears (34, 34', 34", 34"') by the motor (4) of the storage body (9). The movement of the disk of the complementary braking surface is performed, in this case, by an adjustment screw (35) in which the hollow shaft (17) is supported, instead of a slider.

Figure 1:
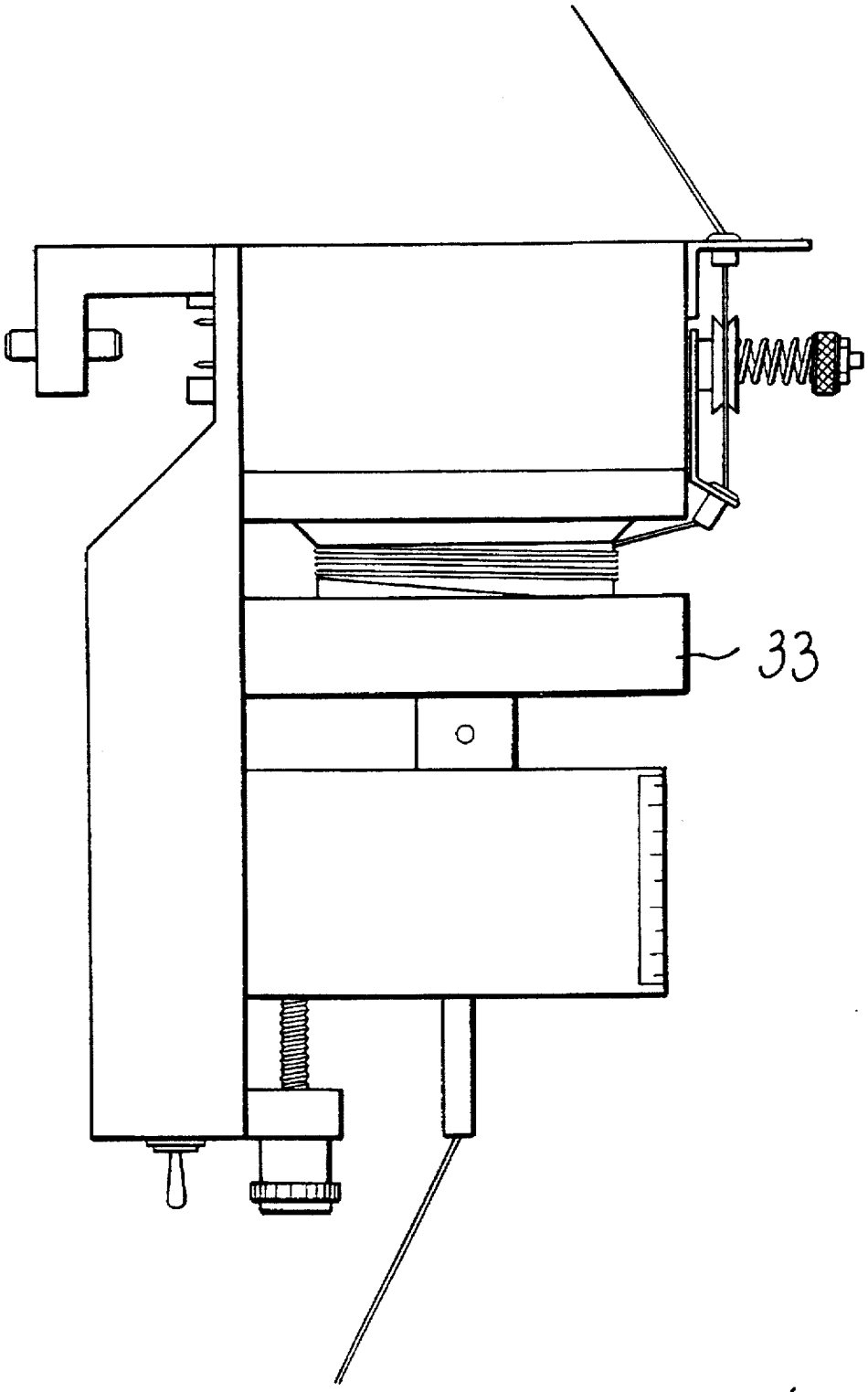
FIG. 1 is a side view of a device according to the invention with parts of the body.
Figure 3:
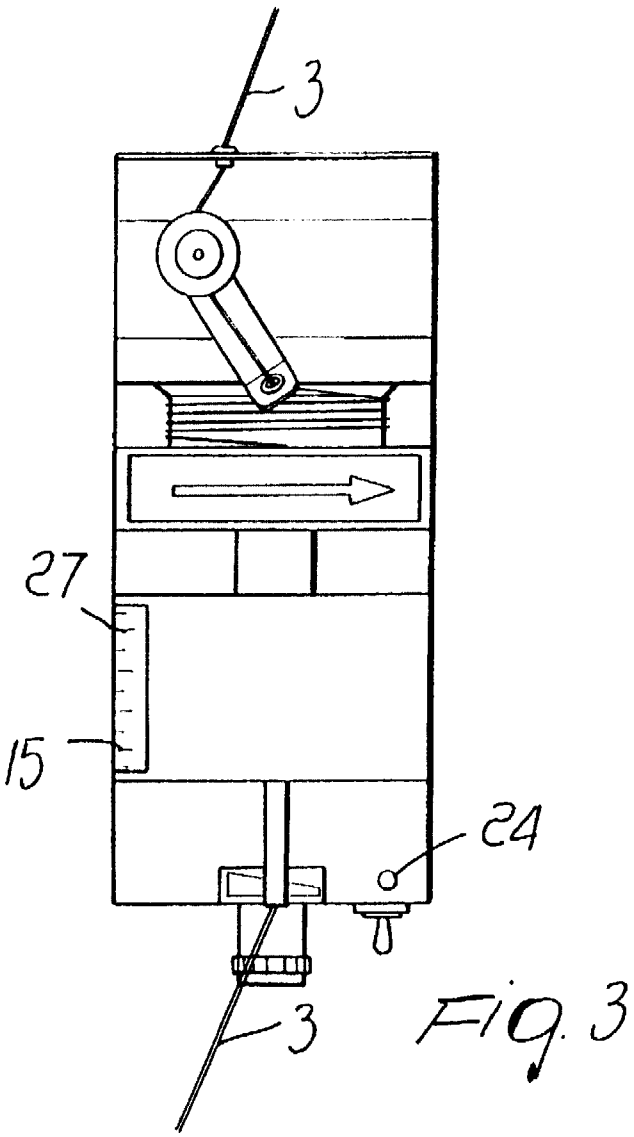
FIG. 3 is a front view of said device with parts of the body.
Figure 2:
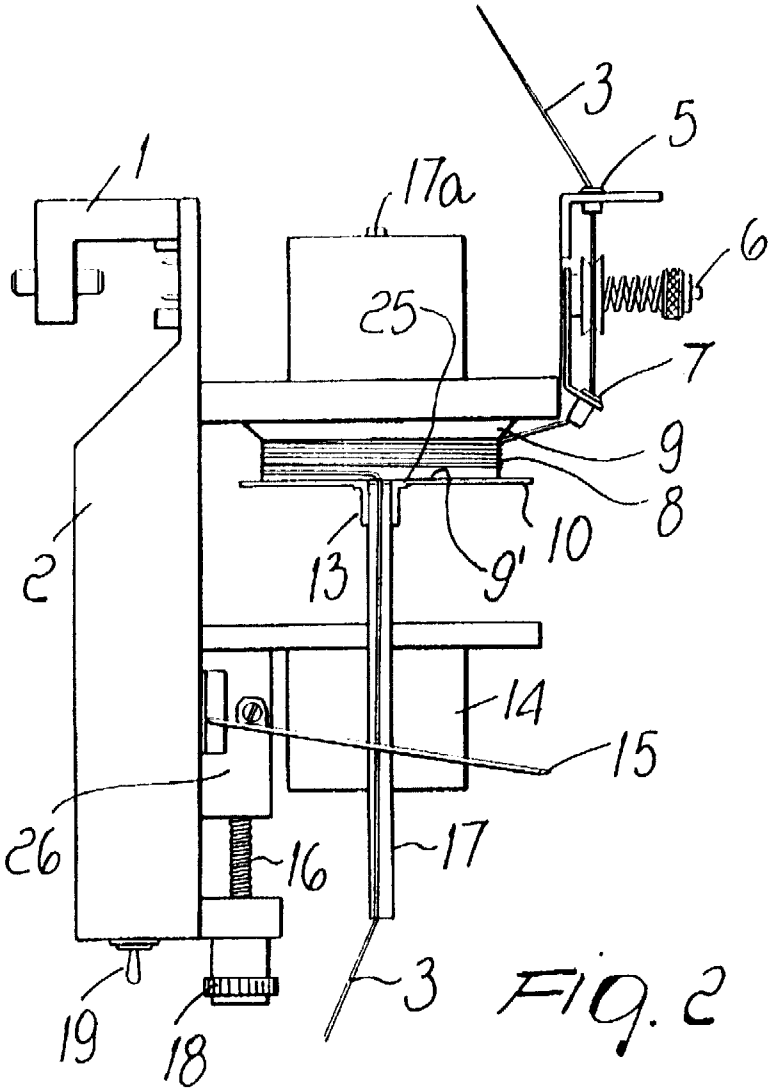
FIG. 2 is a side view of said device without parts of the body.
Figure 6:
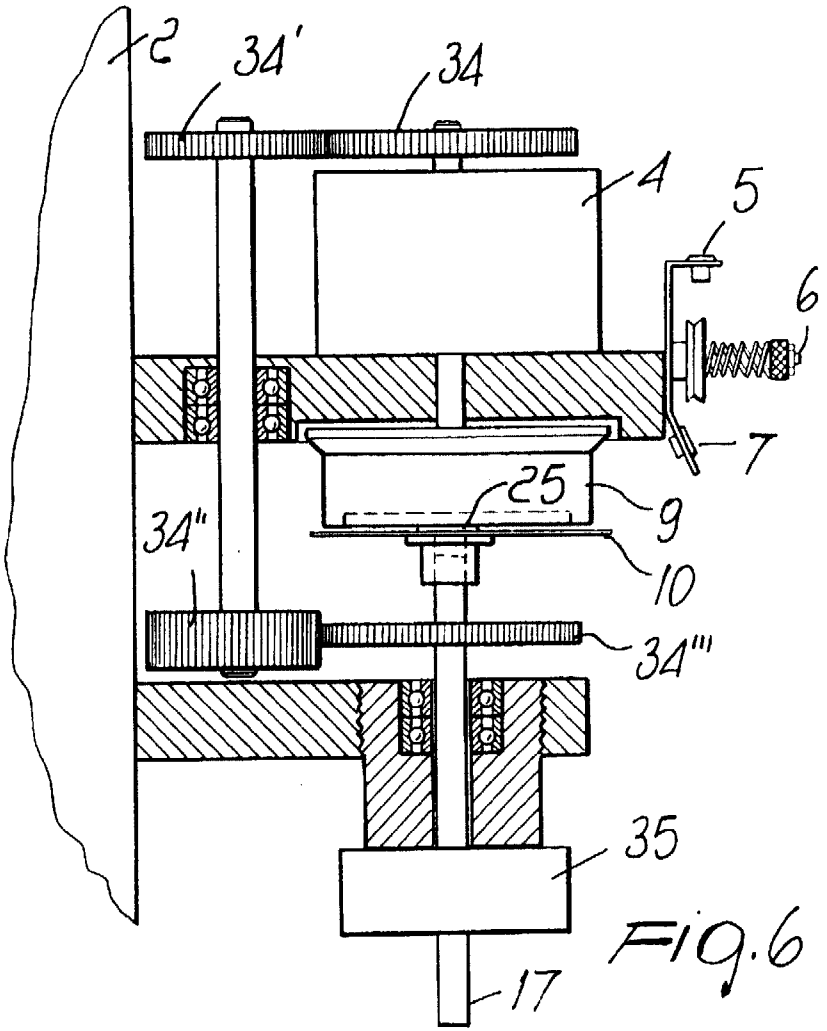
FIG. 6 is a side view of another embodiment, shown partially in longitudinal cross-section, with a common driving motor for the storage body and the disk of the complementary braking surface.
Figure 4:
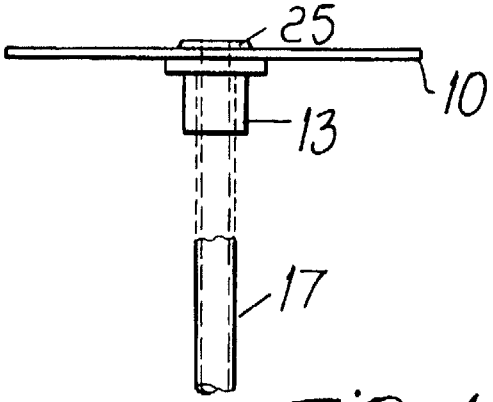
FIG. 4 is a view of the disk of the complementary braking surface with the hub and the hollow shaft shown in a side view.
Figure 5:
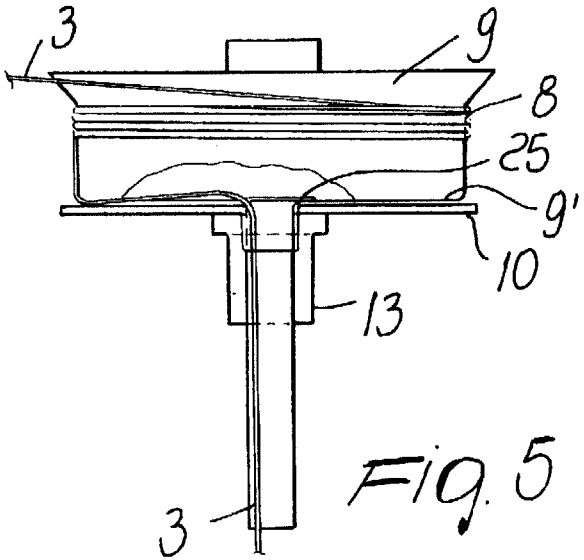
FIG. 5 is a partially sectional side view of a storage body with a reserve winding, shown together with the disk of the complementary braking surface with the hub and the hollow shaft shown in vertical cross-section.

I claim:

1. A thread feeder device for use with a textile machine, comprising:

a frame;

a storage body including a front face and being axially supported along a longitudinal axis thereof by said frame for carrying, substantially without slippage, a wound thread, said thread being tangentially windable on said storage body for forming a reserve winding and being axially extractable therefrom for being fed to a textile machine;

a braking surface being provided at said storage body front face;

a thin flexible disk having a diameter slightly larger than said storage body front face, said storage body and said flexible disk being supported by said frame so as to be rotatably movable in the same rotational direction and axially displaceable with respect to each other for providing a thrust pressure on said braking surface of said storage body, said flexible disk being elastically deformable whereby said thrust pressure is substantially uniform along every point of said braking surface; and a substantially planar complementary braking surface which is provided at a side of said flexible disk which faces said braking surface, said braking surface and said complementary braking surface acting on a length of said thread extending radially therebetween for providing an adjustable thread extraction tension.

2. The thread feeder device according to claim 1, comprising a slider movably supported on said frame, said slider supporting said flexible disk so as to move axially therewith for adjustably setting said thrust pressure and the thread extraction tension.

3. The thread feeder device according to claim 1, further including a shaft, and wherein said flexible disk is mounted on said shaft so as to form an integral structure, and further wherein said integral structure is actuatable for rotational and axial movement.

4. The thread feeder device according to claim 3, wherein said shaft is hollow and said flexible disk comprises a wear free passage located at a central region thereof where said shaft is mounted, the thread extending radially between said braking surface and said complementary braking surface and being axially extractable from said storage body for being fed to the textile machine through said wear free passage and said hollow shaft.

5. The thread feeder device according to claim 3, comprising at least one actuation motor supported on said frame, said motor having rotational speed control means and being drivingly connected to said storage body and said shaft.

6. The thread feeder device according to claim 3, comprising two actuation motors supported on said frame, a first motor being drivingly connected to said storage body and a second motor being drivingly connected to said shaft, said second motor and said integral structure being axially displaceable with respect to said storage body.

7. The thread feeder device according to claim 1, wherein said flexible disk is made of a wear-resistant material chosen from one of a thin flexible plastic material and a metal lamina.

8. The thread feeder device according to claim 1, wherein said flexible disk has a wear-resistant covering at said complementary braking surface.

9. The thread feeder device according to claim 1, wherein said flexible disk is at least partially covered by an annular cover.

10. The thread feeder device according to claim 1, comprising index means for providing a visual indication of relative movement of said flexible disk with respect to the front face of the storage body and consequent indication of the thread extraction tension.

11. A thread feeder device for use with a textile machine, comprising:

a frame;

a storage body including a front face thereof and being axially supported by said frame for carrying, substantially without slippage, a wound thread, said thread being tangentially windable on said storage body for forming a reserve winding and being axially extractable therefrom along a longitudinal axis of said storage body for being fed to a textile machine;

a braking surface being provided at said storage body front face;

a thin flexible disk having a diameter slightly larger than said storage body front face, said storage body and said flexible disk being supported by said frame so as to be and axially displaceable with respect to each other along said longitudinal axis for providing a thrust pressure on said braking surface of said storage body, said flexible disk being elastically deformable whereby said thrust pressure is substantially uniform along every point of said braking surface; and a substantially planar complementary braking surface which is provided at a side of said flexible disk which faces said braking surface, said braking surface and said complementary braking surface acting on a length of said thread extending radially therebetween for providing an adjustable thread extraction tension.

12. The thread feeder device according to claim 11, comprising a slider movably supported on said frame, said slider supporting said flexible disk so as to move axially therewith for adjustably setting said thrust pressure and the thread extraction tension.

13. The thread feeder device according to claim 11, further including a shaft, and wherein said flexible disk is mounted on said shaft so as to form an integral structure, said integral structure being actuatable for rotational and axial movement.

14. The thread feeder device according to claim 13, wherein said shaft is hollow and said flexible disk comprises a wear free passage located at a central region thereof where said shaft is mounted, the thread extending radially between said braking surface and said complementary braking surface and being axially extractable from said storage body for being fed to the textile machine through said wear free passage and said hollow shaft.

15. The thread feeder device according to claim 13, comprising at least one actuation motor supported on said frame, said motor having rotational speed control means and being drivingly connected to said storage body and said shaft.

16. The thread feeder device according to claim 13, comprising two actuation motors supported on said frame, a first motor being drivingly connected to said storage body and a second motor being drivingly connected to said shaft, said second motor and said integral structure being axially displaceable with respect to said storage body.

17. The thread feeder device according to claim 11, wherein said flexible disk is made of a wear-resistant material chosen from one of a thin flexible plastic material and a metal lamina.

18. The thread feeder device according to claim 11, wherein said flexible disk has a wear-resistant covering at said complementary braking surface.

19. The thread feeder device according to claim 11, wherein said flexible disk is at least partially covered by an annular cover.

20. The thread feeder device according to claim 11, comprising index means for providing a visual indication of relative movement of said flexible disk with respect to the front face of the storage body and consequent indication of the thread extraction tension.

21. In a thread feeder device for use with a textile machine, comprising:

a frame;

a storage body including a front face and being axially supported by said frame for carrying, substantially without slippage, a wound thread, said thread being tangentially windable on said storage body for forming a reserve winding and being axially extractable therefrom for being fed to a textile machine;

a braking surface being provided at said storage body front face;

a thread brake for providing a continuously adjustable thread extraction tension, said thread brake comprising:

a thin, low mass flexible disk having a diameter slightly larger than said storage body front face; and a substantially planar complementary braking surface which is provided at a side of said flexible disk which faces said braking surface, said braking surface and said complementary braking surface acting on a length of said thread extending radially therebetween, and wherein said storage body and said flexible disk are supported by said frame so that at least one of them is axially displaceable with respect to the other for providing a thrust pressure at said braking surface, said flexible disk being elastically deformable whereby said thrust pressure is substantially uniform along every point of said braking surface for providing an adjustable thread extraction tension.

* * * * *